United States Patent [19]

Yokoyama et al.

[11] Patent Number: 4,801,134

[45] Date of Patent: Jan. 31, 1989

[54] PAPER FEED APPARATUS CAPABLE OF FEEDING OF COMMON USE PAPERS AND SPECIFICALLY PROCESSED PAPERS

[75] Inventors: Chujiro Yokoyama, Toyokawa; Kazuyuki Fukui, Toyohashi; Haruki Iwatsuki, Toyokawa, all of Japan

[73] Assignee: Minolta Camera Kabushiki Kaisha, Osaka, Japan

[21] Appl. No.: 21,483

[22] Filed: Mar. 4, 1987

[30] Foreign Application Priority Data

Mar. 4, 1986 [JP] Japan ..... 61-47553

[51] Int. Cl.[4] ..... B65H 3/52

[52] U.S. Cl. ..... 271/122; 271/125

[58] Field of Search ..... 271/122, 125, 121

[56] References Cited

U.S. PATENT DOCUMENTS

| | | | |
|---|---|---|---|
| 3,044,770 | 7/1962 | Breuers | 271/122 |
| 3,754,754 | 8/1973 | Peterson | 271/122 |
| 3,857,559 | 12/1974 | McInerny | 271/122 |
| 3,944,210 | 3/1976 | McInerny | 271/122 X |
| 4,105,199 | 8/1978 | Sato | 271/122 |
| 4,368,881 | 1/1983 | Landa | 271/122 |
| 4,515,358 | 5/1985 | Fukui | 271/122 |
| 4,627,607 | 12/1986 | Ishii | 271/122 |
| 4,638,987 | 1/1987 | Sakurai | 271/122 X |

*Primary Examiner*—Richard A. Schacher

*Attorney, Agent, or Firm*—Wenderoth, Lind & Ponack

[57] ABSTRACT

The paper feeding device of the present invention comprises a paper holder for holding a stack of large number of paper sheets; a first roller for sheetwise feeding out paper sheets from the stack in or on the holder; a regular rotation roller for further feeding each of paper sheets and rotatably mounted at a position downstream from the first roller when looking in the paper feeding direction; and a paging roller mounted in opposition to the regular rotation roller. The paging roller is driven always in such a rotational direction for drawback of sheet or sheets in the reverse direction relative to the regular and forward paper feed direction when one or more common class paper sheet or sheets or a plurality of special class paper sheet of a different quality then common class paper sheet is/are fed between the regular rotation roller and the paging roller. In addition the paging roller is rotated as a follower roller following the fed sheet under the action of the regular rotation roller when only one special class paper is introduced between the both rollers.

5 Claims, 7 Drawing Sheets

FIG.3 (ii)
FIG.3 (iii)
FIG.3 (iv)

FIG.4 (ii)
FIG.4 (iii)
FIG.4 (iv)

FIG.8 (ii)
PRIOR ART

FIG.8 (iii)
PRIOR ART

FIG.8 (iv)
PRIOR ART

PAPER FEED APPARATUS CAPABLE OF FEEDING OF COMMON USE PAPERS AND SPECIFICALLY PROCESSED PAPERS

FIELD OF THE INVENTION

This invention relates generally to paper feed apparatuses. It relates more specifically to paper feed apparatuses applicable to electronic photocopiers and fitted with a sheet stack or overlapped sheet loosening and individual paper feeding apparatus or briefly paging mechanism arranged at or in proximity of a downstream position from the paper feed-out or dispensing roller when seen generally in the paper feeding direction and comprising regularly rotating feed roller means and normally reversely rotating paging roller means cooperating therewith.

BACKGROUND OF THE INVENTION

As is well known to those skilled in the art, various kinds of paper are used nowadays for photocopiers. These papers or more broadly sheets are, however, classified mainly into two categories. One is the common class paper and the other is the special class paper. The common class papers herein referred to as such, are most commonly used in citizens' daily life. This kind of paper has a relatively rough surface on which, generally, additives thereto remain in powder-like state and as deposits thereon. During passage between and through a pair of feed rollers, it is believed that these additives will act as rolling medium to a certain degree, thus providing a lesser friction coefficient similar to rolling one, relative to the rotating feed rollers. The special class papers include overhead projector paper, briefly referred to herein as OHP-sheet; secondary original drawing sheet; offset printing master sheet and the like, having a relatively smooth surface and remaining on the surface substantially no powder-like additives. During use, this kind of paper is believed to provide a sliding friction coefficient through and between a pair of feed rollers. Therefore, the coefficient amounts to a relatively high value.

It is demanded for the paper feed mechanism used in the photoelectric copier machine to use not only the comnon class papers, but also special class papers as specifically referred to above, and indeed, to provide a highly stabilized feedability.

In the case of such a paper feed mechanism arranged at a downstream position when seeing in the paper feed direction and comprising a regularly revolving feed roller and a normally reversedly rotating paging roller as a mating member cooperating therewith, when the latter roller is driven in the reversed sense which means such rotational direction as returning the sheet(s) in the reversing direction, while the feed roller is kept always in regular rotation in paper feeding direction, for feeding a sheet of the special class paper, having thus a considerably high friction coefficient, failure in paper feed has occurred rather frequently, thereby constituting a grave drawback in the art.

For dissolving such a conventional drawback in conventional art, a torque limiter was fitted to the paging roller, and indeed, for such purpose as to provide a stabilized paper feed performance, even in use of special class paper sheets having a high friction coefficient as was referred to hereinabove, while, on the other hand, always assuring the reliability in the paging roller performance.

As an example thereof, Japanese Open Utility Model Publication No. (unexamined) Sho-60-47741 may be raised. In this specific prior art, a torque limiter is fitted to the paging roller and as the material for the both mutually mating rollers, polynorbonene rubber representing a superior antifrictional performance is utilized for molding purpose for these rollers.

With provision of such torque limiter attached to in the aforementioned way, and if a paper sheet is fed at the nip of these mating rollers, the paging roller will rotate in the paper feed executing direction by virtue of the follower like motion of the paging roller under the influence of the sheet-carrying force provided by the regularly revolving feed roller. If, however, two or more paper sheets are introduced between these rollers, the paging roller will be caused to reverse its rotational direction for urging the second and further sheets, if any, to make a return movement towards the paper feed cassette. Therefore, it will be seen that even if a sheet of special class paper, having a high friction coefficient should be introduced into the nip portion between the both rollers, troubles in paper feed operation could not be encountered.

On the other hand, we have experienced, however, such that the paging mechanism, even if fitted with torque-limiting means represents several drawbacks, as will be later more fully described with reference to the drawings.

SUMMARY OF THE INVENTION

A main object of the present invention is to provide an improved paper feeding device having a highly stabilized paper feed performance.

Another object is to provide an improved paper feeding device of the above kind, irrespective of kind and nature of the feeding paper, either of common class or of special class, and without any feeding troubles as otherwise frequently met with.

As a preferred advantageous aspect of the inventive paper feeding apparatus, the latter comprises means for holding a stack of large number of paper sheets; a first roller for sheetwise feeding out paper sheets from the stack in or on said holding means; a regular rotation roller for further feeding each of said paper sheets and rotatably mounted at a position downstream from said first roller when seeing in paper feeding direction; a paging roller mounted in opposition to said regular rotation roller; and drive means for driving said regular rotation roller and paging roller, said paging roller being operated at different modes depending upon the class of the paper sheet.

The paging roller is driven always in such a rotational direction for draw-back of sheet or sheets in the reverse direction relative to the regular and forward paper feed direction when one or more common class paper sheet or sheets or a plurality of special class paper sheet is/are fed between said regular rotation roller and said paging roller. In addition, said paging roller is rotated as a follower roller following the fed sheet under the action of said regular rotation roller when only one special class paper sheet is introduced between the both rollers.

The drive means comprises a drive source and a torque limiter adapted for transmitting the driving force from said drive means to said paging roller and within a predetermined range of torque.

The above and other objects, features and advantages of the present invention will become more apparent from the following description when taken in conjunction with the accompanying drawings in which substantially a preferred embodiment of the present invention together with certain related prior art mechanisms, are shown by way of illustrative example.

BRIEF DESCRIPTION OF THE DRAWINGS

In the following description, like parts are designated by like reference numbers throughout the several drawings.

DETAILED DESCRIPTION OF RELATED PRIOR ART

In advance of commencement of detailed description of substantially a preferred embodiment of the invention, structure and related drawbacks of torque limiting means will be set forth hereinbelow and with reference to the accompanying drawings, so far as the related prior art is concerned.

Figure 8:
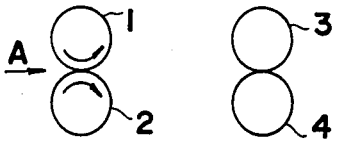
FIG.8 (i) PRIOR ART
FIGS. 8, (i)–(v), is an explanatory schema, wherein several steps of paper sheet feeding operation in a comparative conventional paper feeder.
Figure 8:
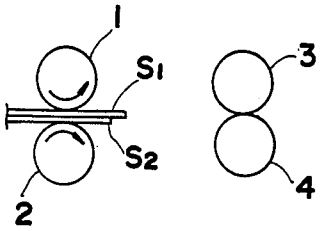
FIG.8 (i) PRIOR ART
Figure 8:
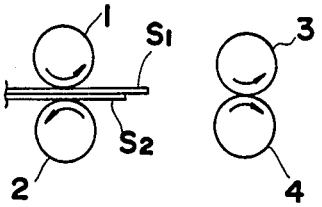
FIG.8 (i) PRIOR ART
Figure 8:
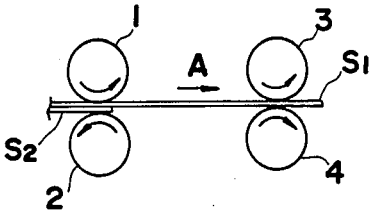
FIG.8 (i) PRIOR ART
Figure 8:
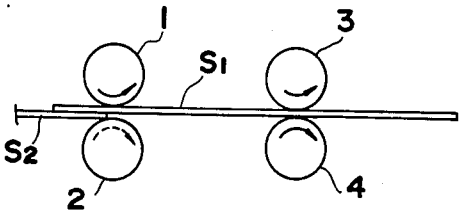
FIG.8 (v) PRIOR ART

Although the torque limiter per se will be more fully described later herein, conventional drawbacks are further described with reference to substantially FIGS. 8 and 9, for better understanding of the invention.

Figure 9:
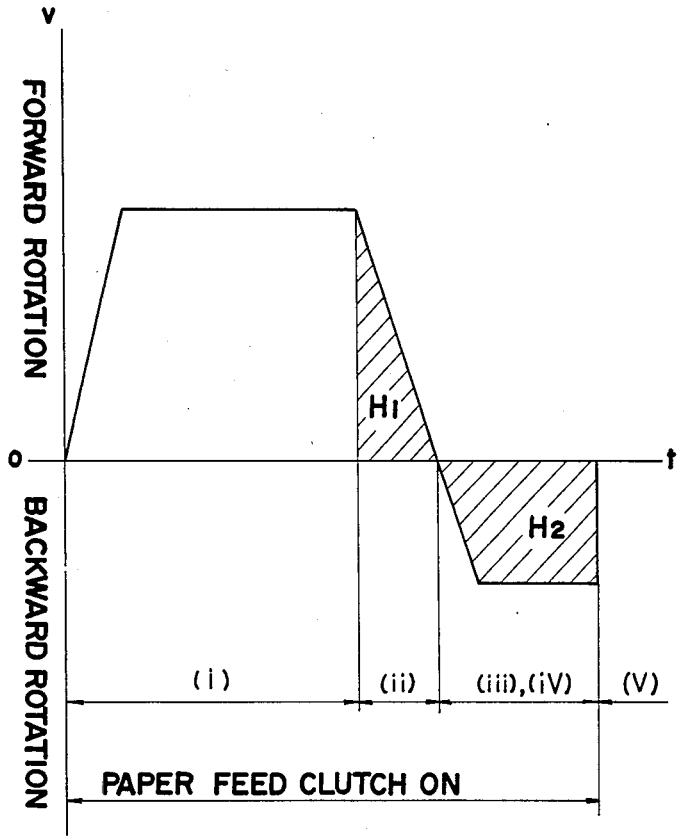
FIG.9 PRIOR ART
FIG. 9 is a chart showing a comparison between the paper carrying momenta as obtainable with regular and reverse rotation of the paging roller, respectively, under ON-operation of the paper feed clutch.

In FIG. 9 representing a graph for illustration of the rotating state of a paging roller, wherein the rotational speed, v, of the roller has been plotted against time, t.

With ON-state of a paper feed signal, a paper feed clutch, not shown, is brought into ON. Then, a regularly rotatable roller 1 is driven in the paper feed direction "A", while a paging roller 2 is driven in the reverse direction through the intermediary of a torque limiter, not shown. With ON-state of the paper feed clutch, a torque limiter is operated by the friction force with the regularly rotating roller 1 and the paging roller 2 will perform a regular rotation as a follower roller to the first roller 1. In this respect, reference may be had to step (i) of FIG. 8.

If more than two paper sheets S1;S2 are fed to the nip existing between the two rollers 1 and 2, a slip may occur between the sheets S1;S2 and thus the torque limiter will be brought into disabled and unoperational state and the paging roller 2 will turn to its reversedly rotating state. However, since there is a inertia force preventing such a sudden rotational change, the roller 2 will continue the regular rotation for the time being (refer to step (ii) in FIG. 8. Only after execution of regular revolution for a certain predetermined time period by virtur of the inertia force as referred to above, the roller 2 turns to rotate reversingly (refer to steps (iii) and (iv) in FIG. 8. When the paper feed clutch becomes OFF, the leading edge cf first sheet S1 is already squeezed by and between carrier rollers 30 and 40, FIG. 1, arranged at a downstream position, thereby the sheet being energized physically with a conveying force, while the regular rotation roller 1 is rotated in regular direction, but in the follower manner to the advancing movement of the first sheet S1 by virtue of OFF-state of the one way clutch (refer to step (v) in FIG. 8. On the other hand, second and occasionally accompanying further sheets, groupingly denoted with single symbol S2, will once protrude slightly downstream from the nip point and then pulled back to a point in close and rear proximity of the nip line, when seeing in the general paper conveying direction.

In order to carry out the above pull-back operation for the second and occasionally appearing further sheets S2 rear of the nip line after execution of forward drive of the first sheet S1, the carrying momentum H2 in the region including steps (iii) and (iv) must be larger than that H1 in the region (ii) applied to the second and further sheets S2 by the paging roller 2, as is schematically illustrated in FIG. 9.

It should be noted, however, that the torque limiter as used therein is designed and arranged to have a relatively small torque in such a way that when only a single sheet, irrespective of its material kind, either common class or special class, is squeezed at the nip line, the paging roller performs a normal rotational movement ny acting as a follower. Thus, at an occasional introduction of two or more paper sheets into the nip line, the time period necessary for transfer from regular to reverse rotation of page roller 2, from step (ii) to (iii) shown in FIG. 3, will become considerably longer than the optimal. In addition, it is to be noted that ON-period of the paper feed clutch should not be longer than a predetermined relatively short time interval, and indeed, in consideration of the sheet delivery force providing the timing destined at out-delivery roller pair as at 30;40, FIG. 1, which is mounted in downstream proximity of the paging mechanism. As a result, the time period allocated to steps (iii) and (iv) will become correspondingly short. If additional two or more sheets S2 should occasionally be introduced in position, the leading edges could frequently be squeezed at the nip, thus leaving thereat without being further conveyed. And, further occasionally, these overlapped sheets may be thence further conveyed to and caught by the delivery rollers as at 30;40. Such phenomenon is called "double feed" which means naturally a grave drawback in the art. Even if the leading edges of second and further sheets S2 should have been drawn back to such a point slightly rear of the nip line, the paging roller 2 will execute regular rotation as a kind of follower by receiving motion by contact with the forwardly moving first sheet S1, thereby the paging roller performing "accompanied rotation" (refer to a dotted small arrow shown at step "v" in FIG. 8 and resulting in an "accompanying double feed" of the second and further sheets. As is highly well known to those skilled in the art, this phenomenon constitutes another conventional drawback in the art.

DESCRIPTION OF PREFERRED EMBODIMENT OF THE INVENTION

Now, referring to FIG. 1, a static photocopier to which a preferred embodiment of the inventive paper feeding device has been applied will be described in detail.

Numeral 10 represents a paper feed cassette, having a vertically movable mounting plate 11 mounting a number of sheets S formed into a stack. The mounting plate 11 is electrically urged upwards by a push-up roller 15 kept in pressure contact therewith from below. The cassette-containing space of the machine, appearing in FIG. 1 is called "charging space". As seen, the upper surface of the paper stack S is kept in pressure contact with a paper feed-out roller 16. With regular rotation, shown by a small arrow a, paper sheets S is fed out, one by one, in the general feeding direction, shown by arrows "A", naturally beginning from the uppermost sheet. There is provided a paging mechanism arranged at a downstream position in the regular feed passage and in proximity of the paper feed-out roller 16.

The paging mechanism comprises an upper, regular rotation roller 20 and a lower, paging roller 21 cooperating therewith. The paging roller 21 is mounted on a small movable frame member 22 through a short shaft 23, said frame member having an extension arm 22*a* which is pivotably mounted on a stationary pin 24 for allowing the frame member to execute a pivotal movement around the pin acting as a kind of pivot pin.

A tension spring 25 is tensioned between outer end of said frame extension and a certain fixed point, not shown, thereby the paging roller being always urged resiliently and upwardly towards pressure contact with the regular rotation roller 20 for cooperation therewith.

As shown, the feed-out roller 16 and the regular rotational roller 20 are rotating in the regular direction as shown by respective small arrows a, adapted for feed-out of the sheet S, one by one and towards the conveying roller pair 30;40. The general paper feed direction is shown by arrows "A", as was referred to hereinbefore.

Figure 1:
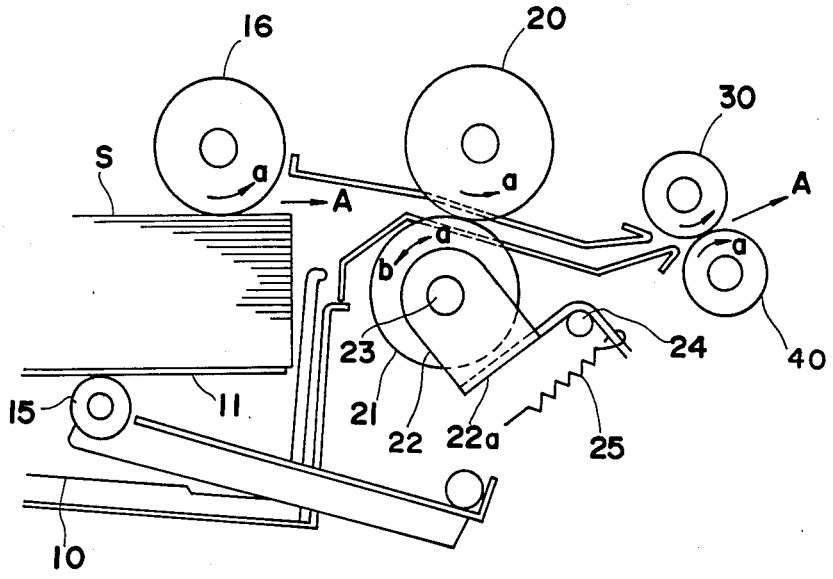
FIG. 1 is a schematic elevational view of several constituents of a paper sheet feeder according to the invention.

On the contrary, the paging roller 23 is normally driven in the reverse direction, as shown at "b" of a double head arrow in FIG. 1, in comparison with the regular paper feeding direction "A". The necessary driving force for normal rotation of these rollers 16;20 and 21 derives from a main motor and proper and co-related transmission systems, not shown, for the reason of highly well-known nature.

As seen, a conveyer roller pair 30;40 is provided at a downstream position when seeing in the paper feeding direction and at a small distance from the paging mechanism comprising several constituents 20–25, as was referred to hereinbefore. Although not shown, several further and similar conveyer roller pairs are provided within the machine. All these conveyer rollers including those which are denoted with 30;40, are driven from a main motor, not shown, and indeed, in the regular rotational direction as shown by small arrows "a" for execution of paper sheet conveying jobs.

Paper feed roller 16 and regular rotation roller 20 are made of a conventionally employed material, while, on the other hand, paging roller 21 comprises a core cylinder member 21*a* preferably made of foam resin material and wrapped with a cover cylinder 21*b* of rubber, thus showing a double layer structure. Kinds of material employed; hardness and surface treatment particulars will be set forth later more specifically.

Figure 2:
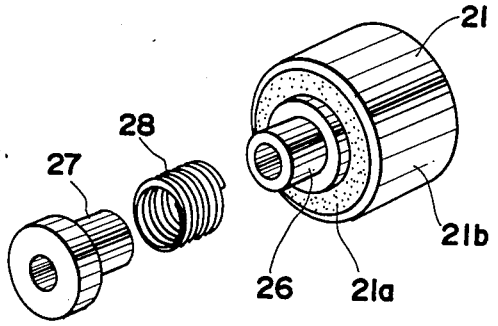
FIG. 2 is an exploded perspective view showing substantial constituents of a paging roller adopted in the inventive paper sheet feeder.

Paging roller 21 is fitted with a torque limiter which comprises, as a preferred embodiment shown in FIG. 2, a shaft member 26, a boss member 27 coupled therewith and a coil spring 28 provided between hollow core member 21*a* and boss member 27 and held under compression. When a reversely rotating torque is transmitted to paging roller shaft 23, thence further to boss member 27 and through the coil spring 28 held under pressure between the latter and foam resin-made hollow core 21*a* which is naturally part of the paging roller 21, thereby the latter being rotated in the reverse direction. This reversingly rotating state of paging roller 21 will be referred to as "off service" position hereinafter.

On the other hand, when an outside driving force in the regular rotational direction, larger than the spring pressure at 28, is applied to the paging roller, a slip may occur between the end of spring 28 and boss 27 or foam resin core 21*a*, thereby rotation of the paging roller being turned to regular one. This state will be referred to as "in service" or "operating" hereinafter.

In the practice of the present invention, important are such factors as the torque value necessary for operation of the torque limiter from "off service" to "in service"; friction force acting between the roller 20/21 and the sheet S, and among others, the following formulae must be satisfied:

$$\mu i.Ns > \mu t.Ns > Ts/R > \mu p.Ns > \mu o.Ns \quad (1)$$

$$\mu r.Ns > Ts/R \quad (2)$$

where

Ts: torque value at torque limiter; gr.cm.

Ns: pressure force at paging roller; gr.

R: radius of paging roller; cm.

$\mu i$: friction coefficient between regular rotation roller and sheet;

$\mu t$: friction coefficient between paging roller and sheet;

$\mu p$: friction coefficient between paging roller and common class sheet;

$\mu o$: friction coefficient between sheets;

$\mu r$: friction coefficient between regular rotation roller and paging roller.

As shown by the formula (1), the acting force (Ts/R) at the torque limiter is set to be higher than the friction force ($\mu p.Ns$) between common class sheet, having a relatively small friction coefficient, and the paging roller 21, and lesser than the friction force ($\mu t.Ns$) between special class sheet, having a relatively high friction coefficient, and the paging roller. Further, the friction force ($\mu i.Ns$) between regular rotation roll 20 and sheet S is set to be higher than any one of the foregoing values: ($\mu t.Ns$), (Ts/R) and ($\mu p.Ns$). And further, the inter-sheet friction force ($\mu o.Ns$) is always smaller than any one of the foregoing specific values.

Still further, as shown by the formula (2), the acting force (Ts/R) at the torque limiter is set to be lesser than the friction force ($\mu r.Ns$) between regular rotation roller 20 and paging roller 21.

As a reference, in the case of conventional automatic paper feeders, the torque value, Ts, at the torque limiter for paging roller has been set to satisfy the following formula:

$$\mu o.Ns < Ts/R < \mu p.Ns$$

where, $\mu o$: friction coefficient between common class sheets.

In the present embodiment, more specifically, the pressure force, Ns, of paging roller is 300–400 gr.

| | |
|---|---|
| the torque value, Ts, | 500–600 gr.cm; |
| radius of paging roller, R | 1.5 cm; |
| friction coefficient, $\mu r$, between regular rotation roller 20 and paging roller 21 | 2.0–3.0, preferably about 2.5; |
| friction coefficient, $\mu p$, between common class sheet and paging roller 21 | 0.7–1.2, preferably 1.0–1.2; |
| friction coefficient, $\mu t$, between paging roller 21 and special class sheet | 1.5–3.0, preferably 1.6–2.5; |
| intersheet friction coefficient, $\mu o$,: | |
| for common class sheets | about 0.3–0.7; |
| for special class sheets | about 0.3–1.0. |

The regular rotation roller 20, made of polynorbonene, hardness: 25 degree (JIS - A), while, in the case of paging roller 21, foam material 21*a* is urethane resin, and rubber material 21*b* is polyolefine rubber, hardness 40 degrees (ASKER-C), thickness: 0.8 mm. The surface of polyolefine rubber has been roughened by means of sand paper or by sand blasting, to 100±50 μm or so. Adoption of covering with polyolefine rubber material and surface-treated as was referred to above concerning the paging roller 21, was made for the purpose of proper adjustment of friction coefficient and additionally for absorbing occasionally generating vibrations during cooperation with the mating roller 20. In this way, necessarily invited time-functional variation of the friction coefficient can be suppressed to a possible minimum.

Next, the operation mode of paging roller will be described more in detail with reference to FIGS. 3 and 4 in combination. In these drawings, steps (i)–(v) correspond to those denoted (i)–(v) in FIGS. 8 and 9.

Figures 3, 4:
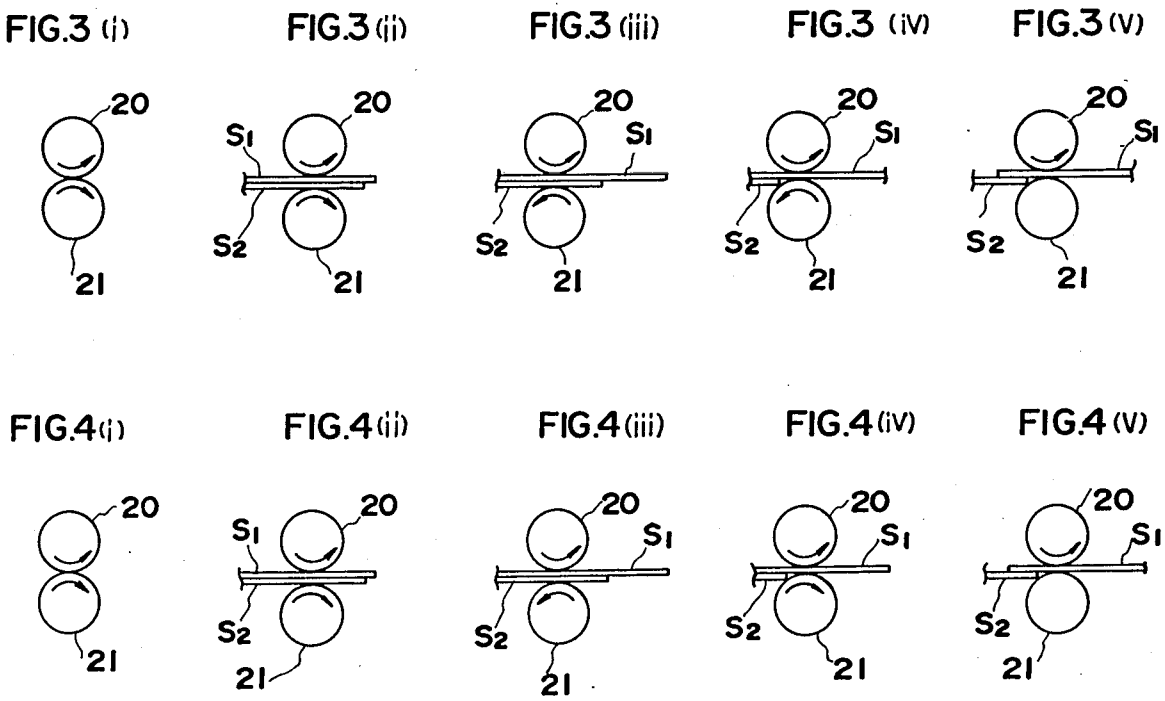
FIGS. 3, (i)–(v), illustrates several feeding steps appearing in the inventive feeder when common class paper sheets are introduced between said regular rotation roller and said paging roller, especially showing operational modes of the latter roller.
FIGS. 4, (i)–(v), illustrates several feeding steps appearing in the inventive feeder when special class paper sheets are introduced between said regular rotation roller and said paging roller, especially showing operational modes of the latter roller.

FIG. 3 illustrates the feeding mode with use of common class sheets, while FIG. 4 illustrates the corresponding steps using, however, special class sheets.

With the paper feed clutch ON, the roller 20 is driven to rotate in the regular rotational direction. As for the paging roller 21, its shaft portion 23 is driven in the reverse direction at this stage. Since, however, the friction force $\mu r.Ns$, has been preset to be stronger than the operational force, Ts/R, of the torque limiter, the latter can operate, thereby paging roller 21 operating as a kind of a follower to the regular rotation roller 20. In this respect, reference shall be had to step (i) at FIGS. 3 and 4.

When more than two sheets, S1; S2, are introduced to the nip line, the torque limiter will become off-service, by virtue of the intersheet friction force, $\mu o.Ns$, being lesser than the operational force, Ts/R, resulting into rotational conversion at paging roller 21 from regular to reverse. However, on account of the very existence of rotational inertia thereat, the conversion, refer to FIGS. 3 and 4 at (iii), is brought about, only after a lapse of a certain short time period of regular revolutions, refer to steps (ii) in FIGS. 3 and 4. Since the torque force value, Ts, at the torque limiter, has been preset at a certain higher level than that adopted in the conventional technique, the time lapse before execution of rotation reversal will be highly short. And, by such rotation reversal, the second and occasionally existing further sheets, S2, will be drawn back to such a position where the otherwise leading edge or edges of this or these sheets arrive(s) at slightly rear of the nip line.

In this instance, only first sheet S1, exists with its originally leading edge covering the nip. In the case of the first sheet S1 being of the common class, the foregoing formula (1): $Ts/R > \mu p.Ns$ will be satisfied, the torque limiter being off service and kept in unoperational position and the paging roller 21 continuing its reverse revolution, refer to step (iv) in FIG. 3. On the other hand, as for the regular revolution roller 20, the friction force ($\mu i.Ns$) between roller and sheet is higher than the friction force ($\mu p.Ns$) between paging roller (21) and common class sheet, the first common sheet S1 will be fed forward, even though the torque limiter is kept in off-service position. Further, in the case of the first sheet S1 belonging to the special class and kept by its originally leading edge in contact with the nip, the condition: $\mu t.Ns > Ts/R$ shown in the foregoing formula is satisfied, and then the torque limiter is brought into operation, thereby the rotation of paging roller 21 being converted to regular one (refer to FIG. 4 at (iv) by acting as a follower to the special class first sheet S1 which is now being fed forward.

Even when second and occasionally further sheets S2 are urged to invade into and through the nip line, the torque limiter is instantly brought into off-service position by virtue of the intersheet friction force ($\mu o.Ns$) acting between S1 and S2 preselected lesser than that ($\mu t.Ns$) acting between special class sheet and paging roller 21 and further, since the aforementioned relationship: $\mu t.Ns > Ts/R$ is satisfied, resulting in invitation of the reversed rotation thereof and second and further sheets being drawn back to slightly rear of the nip line.

When the fed first sheet S1 has passed through the paging mechanism, thence instantly conveyed forward to the carrier roller pair 30;40 and caught therebetween and still further conveyed on exclusively by subjecting to the conveying force provided by this roller pair, until the sheet reaches a resist roller, not shown, which is positioned in rear of the transfer section, not shown, of the machine.

Simultaneously with reception of carrier force by the leading end of first sheet from the carrier roller pair 30;40, paper feed clutch becomes off, and the paging roller 21 will hold its off-service position, refer to steps (v) in FIGS. 3 and 4, since the torque limiter is kept in off-service position. It should be noted at this stage of description that the torque limiter acts as a kind of brake means for the paging roller 21.

In the following, various and different characteristics caused by material difference and the like of said both rollers 20; 21 will be described based upon our practical experiments.

Figure 5:
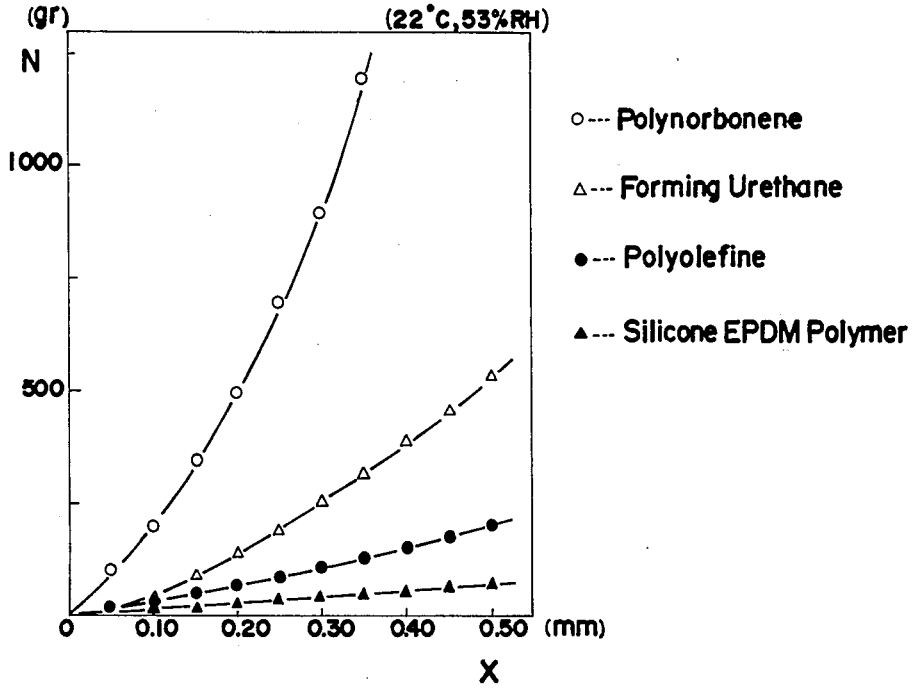
FIG. 5 is a stress-strain chart, showing effects of usage of different roller materials.

In the chart shown in FIG. 5, stress-strain characteristics of the roller as per se will be described with use of various materials. In this case, the stress (N) is found from the formula: $N = A \cdot X^R$ and values A and R for several selected materials are shown in the following Table 1.

TABLE 1

| material | A | B |
|---|---|---|
| Silicone EPDM Polymer | 165 | 1.14 |
| Polyolefine | 440 | 1.14 |
| Polynorbonene | 1450 | 1.46 |
| Foam-Urethane | 1030 | 1.25 |

In the following Table 2,

TABLE 2

| | Temp. | | | |
|---|---|---|---|---|
| | 26 deg. C., 43% RH | | 5 deg. C., 35% RH | |
| | Sheet | | | |
| material | Common Class Sheet, Unit weight, 64 g/m$^2$ | OHP-Sheet non-treated | Common Class Sheet, Unit Wt., 64 g/m$^2$ | OHP-Sheet non-treated |
| Silicone-EPDM Polymer | 0.82 | 2.19 | 0.83 | 2.60 |
| Polyolefine | 0.90 | 1.85 | 0.70 | 1.70 |
| Polynorbonene | 1.90 | 2.37 | 1.95 | 2.40 |
| Foam-Urethane | 0.90 | 1.45 | 0.57 | 1.66 |

As may be well understood, silicone EPDM polymer and polyolefine are highly suitable for the manufacture of paging roller 21 as used in the present invention.

As for the friction coefficient thereof, it amounts to about 1.0 or so for common class sheets, and to about 2 or so for special class sheets, as is clearly seen from Tale 2. The material polynorbonene represents solid rubber, generally being used, and shows a high friction coefficient about 2 or so, relative to common class and special class sheets. Thus, this material is highly suitable for the manufacture of regular rotation roller 20.

On the other hand, the material foam-urethane represents friction coefficient about 0.6 or so for common class sheets and about 1.5 or so for special class sheets. This material has been used for conventional reverse drive type paging rollers without fitting with torque limiting means. In the case of special class sheets, however, this material shows too much higher friction coefficient, resulting in an excess degree of sheet-drawback force and giving rise frequently to failures in paper sheet feeding operation.

Further, in the case of conventional torque limiter systems, both regular rotation roller end and paging roller have been prepared from general purpose solid rubber. In case of a single sheet kept in contact by its leading edge with the nip line between these two rollers, the torque Ts exerted by torque limiter must be properly preset, so as to satisfy the necessary mathematical requirement of $Ts/R<\mu p.Ns$, in order to let the paging roller rotate always definitely and reliably in the regular sheet-feeding direction by revolving in regular sense for execution of "accompanied" rotation.

However, as in the present embodiment, use is made of silicone-EPDM-polymer or polyolefine rubber for the preparation of outside peripheral layer of the paging roller 21, the feeding job of common class sheet can not be disturbed, even if tee roller should be kept in reversed rotation, refer to FIG. 3 at step (iv), since these specifically selected materials demonstrate highly favorable friction coefficient less than unity relative to common class sheets.

Figure 6:
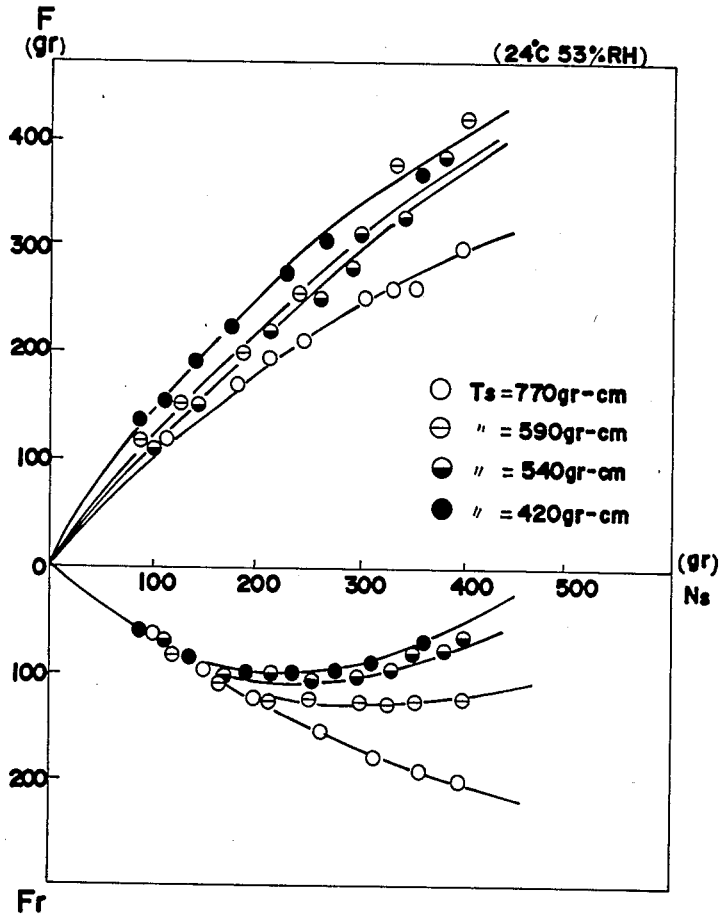
FIG. 6 is a combined chart, wherein paper sheet feeding force (F) and paging force (Fr) have been plotted against pressure force (Ns), taking various values of torque of a torque limiter adopted in the inventive feeder.

FIG. 6 is a combined chart showing various sheet-feeding characteristics at different torque values Ts relative to common class sheet, unit weight: 64 gr/m$^2$. In this case, in the positive value field, the sheet-feeding force, (F), while a single sheet is kept in contact with the nip line, and in the negative value field, the paging and rearwardly drawback force (Fr) relative to the second sheet while two overlapped sheets are kept in contact with the nip, are plotted against the pressure force (Ns) appearing at the paging roller 21.

As may be well understood from this chart, paper- or sheet feeding force (F) will become larger with increase of pressure force (Ns) and smaller with increase of torque value (Ts). The paging force (Fr) will become larger with increase of the torque value (Ts). At smaller values of torque (Ts), the paging force (Fr) will become reduced with increase of pressure force (Ns).

Figure 7:
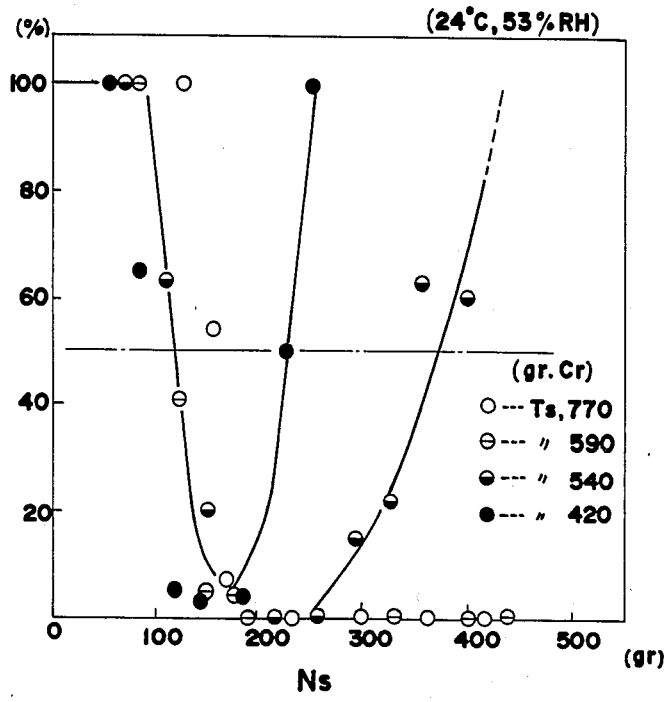
FIG. 7 is a chart wherein overlapped paper feed generating percentage is plotted against pressure force (Ns) with various values of torque at torque limiter employed.

FIG. 7 is a chart showing the generating percentage of overlapped sheets feeding troubles plotted against the pressure force (Ns) and with various values of torque (Ts), say 420 gr.cm, favorable low generating percentage could be realized only with a highly limited range of pressure force (Ns), say 180 gr or so. However, with stepwise increase of torque value (Ts) to 540; 590 and 770 gr, the range of pressure force (Ns) capable of providing favorable low percentage of overlapped sheets can be considerably broadened, resulting in considerable improvement to avoid such failured feeds.

It will be clearly understood that with use of specifically selected-out materials for the preparation of regular rotation roller and paging roller, even if the paging roller 21 is kept in reverse rotational state, successful forward paper feed operation can be realized for a single common class paper sheet existing at the nip, only by keeping the condition of $Ts/R>\mu p.Ns$ existing. Further, even when a single sheet of special class exists at the nip, successful and reliable paper sheet feeding can be realized, by keeping the condition of $\mu t.Ns>Ts/R$ existing, and by keeping the paging roller 21 in regular rotating condition acting as a follower.

It may be further possible, by use of a considerably higher values of the torque (Ts) than those conventionally adoped and preset by those skilled in the art, to provide an automatic high speed paper sheet feeding apparatus satisfying conventional sincere demands and capable of substantially suppressing otherwise liably invited accompanying or accompanied feedings as conventionally and frequently met with.

It will be clear that the automatic paper feeding apparatus embodying the inventive principles foregoingly set forth generally as well as specifically illustrated, must not be limited only to the emodiment(s) per se. As an example, the torque limited may be embodied in other styles and arrangements, such as powder limitter type, a magnetically combined type wherein a permanent magnet is combined with magnetic sheet or sheets.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper feeding apparatus comprising:

means for holding a stack of a large number of paper sheets;

a first roller means for sheet wise feeding out paper sheets in a paper feeding direction from the stack held by said holding means;

a regular rotation roller means for contacting and further feeding each of the paper sheets and rotatably mounted at a position downstream from said first roller means in the paper feeding direction;

a paging roller means for contacting each of the paper sheets and rotatably mounted in opposition to said regular rotation roller means; and drive means for driving said regular rotation roller means and said paging roller means for driving said paging roller means in different rotational modes depending upon the class or quality of the paper sheet being fed.

2. A paper feeding apparatus as claimed in claim 1, wherein said drive means drives said regular rotation roller means and said paging roller means for driving said paging roller means always in a rotational direction for drawback of a sheet or sheets in the reverse direction relative to the regular and forward paper feeding direction when one or more common class paper sheets are fed or when a plurality of spacial class paper sheets of a different quality from common class paper sheet is fed between said regular rotation roller means and said paging roller means.

3. A paper feeding apparat as claimed in claim 2, wherein said drive means drives said regular rotation roller means and said paging roller means for driving said paging roller means as a follower roller following the fed sheet under the action of said regular rotation roller means when only one special class paper sheet is introduced between said regular rotation roller means and said paging roller means.

4. A paper feeding apparatus as claimed in claim 3, wherien said driving means comprises a drive source and a torque for transmitting the driving force from said drive means to said paging roller means and within a predetermined range of torque.

5. A paper feeding apparatus comprising:

means for holding a stack of a large number of paper sheets;

a first roller means for sheetwise feeding out paper sheets in paper feeding direction from the stack held by said holding means;

a regular rotation roller means for further feeding each of the paper sheets and rotatably mounted at a position downstream from said first roller means in the paper feeding direction;

a paging roller means mounted in opposition to and pressed against said regular rotation roller means;

a drive source for driving said regular rotation roller means and said paging roller means;

a torque limiter for transmitting the drive force from said drive source to said paging roller means within a predetermined range of torque; and wherein the following formulae is satisfied:

$$\mu i \cdot Ns > \mu t \cdot Ns > Ts/R > \mu p \cdot Ns > \mu o \cdot Ns \quad \mu r \cdot Ns > Ts/R$$

Where,

Ts: torque value at torque limiter, gr·cm;

Ns: pressure force at paging roller means, gr;

R: radius of paging roller means, cm;

$\mu i$: friction coefficient between regular rotation means and sheet;

$\mu t$: friction coefficient between paging roller means and special class sheet;

$\mu p$: friction coefficient between paging roller means and common class sheet;

$\mu o$: friction coefficient between sheets; and $\mu r$: friction coefficient between regular rotation roller means and paging roller means.

* * * * *